US008205663B2

(12) United States Patent
Abdelrahman et al.

(10) Patent No.: US 8,205,663 B2
(45) Date of Patent: Jun. 26, 2012

(54) APPARATUS AND METHOD FOR MONITORING AND EVALUATING GREENSAND MOLDS

(76) Inventors: Mohamed Abdelrahman, Cookville, TN (US); Michael Baswell, Cookville, TN (US)

( * ) Notice: Subject to any disclaimer, the term of this patent is extended or adjusted under 35 U.S.C. 154(b) by 91 days.

(21) Appl. No.: 12/569,083

(22) Filed: Sep. 29, 2009

(65) Prior Publication Data

US 2010/0078145 A1 Apr. 1, 2010

Related U.S. Application Data

(60) Provisional application No. 61/101,579, filed on Sep. 30, 2008.

(51) Int. Cl.
*B22D 46/00* (2006.01)

(52) U.S. Cl. ..... 164/456; 164/150.1; 164/154.1

(58) Field of Classification Search ..... 164/4.1, 164/456, 150.1, 154.1
See application file for complete search history.

(56) References Cited

U.S. PATENT DOCUMENTS 6,173,757 B1 * 1/2001 Pohlandt ..... 164/456

FOREIGN PATENT DOCUMENTS

JP 57-187143 * 11/1982

* cited by examiner

*Primary Examiner* — Kuang Lin
(74) *Attorney, Agent, or Firm* — Wayne Edward Ramage; Baker Donelson

(57) ABSTRACT

A device for determining the integrity of a greensand mold comprising two or more measurement sensors or plates on a support or supports. The support may comprise a frame straddling a mold production line between the mold machine and the pour station. When the production line is stopped, the measurement sensors or plates are extended to contact opposing sides of a mold and determine electrical characteristics of the mold, including capacitance and inductance. By comparing the electrical characteristics of the mold to the electrical characteristics of recently tested molds in the production line, a determination can be made whether the mold should be used at the pour station.

8 Claims, 13 Drawing Sheets

All Capacitance Data

Right Side Top and Bottom Capacitance Data

Left Side Top and Bottom Capacitance Data

All Capacitance Data

Right Side Top and Bottom Capacitance Data

Left Side Top and Bottom Capacitance Data

All Capacitance Data

Right Side Top and Bottom Capacitance Data

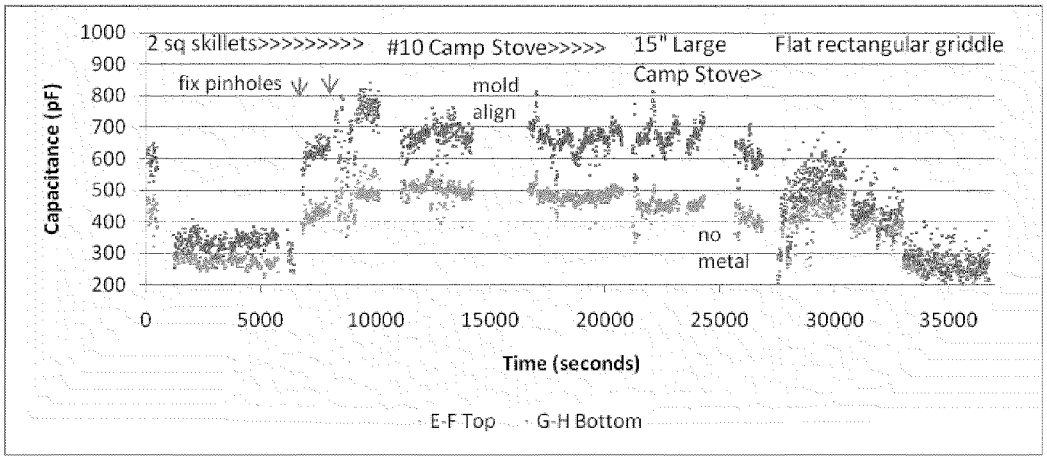
Left Side Top and Bottom Capacitance Data
FIGURE 7I
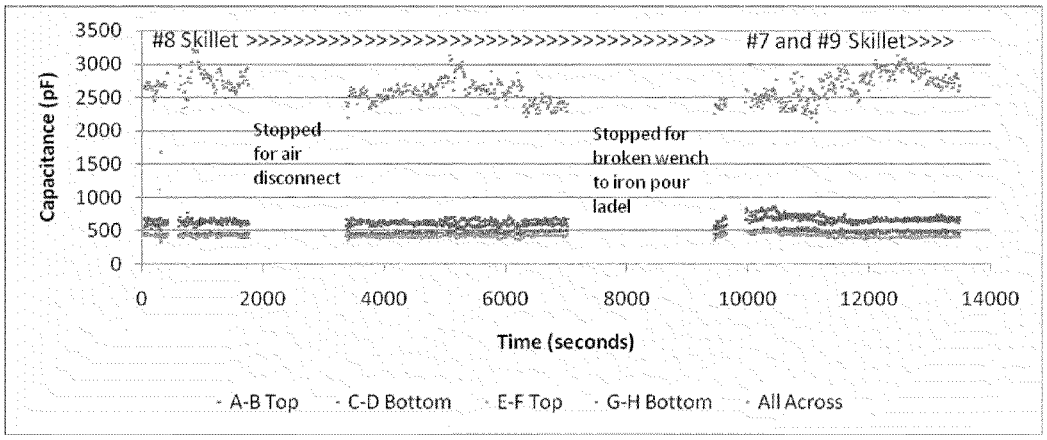
#8 Skillet >>>>>>>>>>>

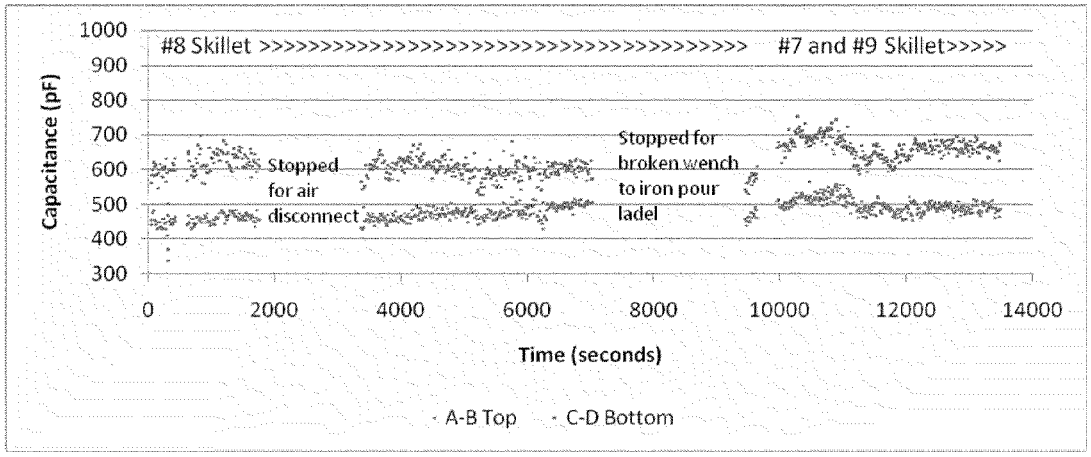
#8 Skillet >>>>

Data Close up of Disa changes in compaction and blow

Right Side Top and Bottom Capacitance Data

Left Side Top and Bottom Capacitance Data

APPARATUS AND METHOD FOR MONITORING AND EVALUATING GREENSAND MOLDS

This application claims priority to Provisional Patent Application No. 61/101,579, filed Sep. 30, 2008, entitled "SYSTEM AND METHOD FOR MONITORING AND EVALUATING GREENSAND MOLDS," and is entitled to that filing date for priority. The complete disclosure, specification, drawings and attachments of Provisional Patent Application No. 61/101,579 are incorporated herein in their entireties by reference for all purposes.

FIELD OF INVENTION

The invention disclosed herein involves a method and system for monitoring and evaluating the characteristics and integrity of greensand molds.

BACKGROUND

Sand casting is a widely used method in today's mechanized society. In a typical sand casting process, a pattern is made which conforms to the external shape of the casting. A cavity in sand using the pattern, the cavity having the desired contours and dimensions of the casting. The mold is typically made in an open frame or flask, and both the flask and the pattern are parted to facilitate removal of the pattern from the sand. When the pattern is removed, a cavity is formed in the casting. The mold is closed, and molten metal poured into the mold to fill the cavity. When the metal solidifies, the casting is shaken out and removed, and the sand is reprocessed.

Greensand (or green sand) casting is one of the most popular and widely used methods for producing sand castings. The term "green" refers to the presence of moisture in the molding sand, and demonstrates that the mold is not dried or baked. The mold material comprises sand in quartz form, clay, and water. The water develops the bonding characteristics of the clay, which binds the sand grains together. Through the application of pressure, mold material is compacted around a pattern to produce a mold with sufficient rigidity to enable molten metal to be poured into it to produce a casting.

Defects can occur in the mold formation process from a variety of sources: moisture level in the green sand, organic impurities, poor ram or squeeze, hard molds, uneven mold hardness, pattern problems, insufficient new sand, and contaminated sand, among others. Greensand characteristics are normally measured from the muller, and are limited to information on the greensand at that time. From the muller, the greensand travels along conveyors, down hoppers, and through nozzles into the mold chambers. Any of these processes can affect the resulting mold properties. In addition, after the greensand mold is made, it is moved to the pour station, and during this movement, the mold may develop cracks or may even collapse. Problems with a mold usually cannot be detected by visual inspection. Unfortunately, undiscovered defects in the sand mold lead to a defective casting, resulting in scrapping of the casting. As the cost of energy rises and competition for higher quality casting of greensand molds increases, the ability to reduce scrap rates and identify process irregularities and problems which affect quality of the casting become increasingly important.

SUMMARY OF INVENTION

In one exemplary embodiment, the present invention comprises a device and related methods for detecting problems with production of a greensand mold. In one embodiment, the device and methods comprise measuring the capacitance or resistance, or both, of a greensand mold in a production line after the mold is made but prior to the pouring station. The measurements may be taken in or at the mold machine, or, in the alternative, at the pouring station, or as close to the pouring station as practical in order to capture any problems or imperfections in the mold caused by transport of the mold on the production line. In one embodiment, measurements are taken far enough away to take accurate measurements and make a decision to pass/fail the mold and bypass or remove the mold in a timely fashion.

In one embodiment, one or more measurement sensors or plates are supported by a frame or support mechanism. The frame may straddle the mold production line between the mold machine and the pour station, although alternative configurations are possible, such as a support passing under the production line, two separate support stands on either side of the production line, or the like. Multiple measurement sensors or plates on a particular side of the mold may be used, and sensors or plates may be used on one or more sides of the mold.

The location of the frame with respect to the pour station depends on the speed of the production line, the time to perform the test, and the time to complete the test and make a decision to remove the mold as faulty. In one exemplary embodiment, the frame is positioned on the mold production line approximately 8 molds (or steps) before the pour station.

The time to perform the test should be as short as possible in order to reduce or avoid any delay in the production line. In a preferred embodiment, the time to perform the test is equal to or less than the amount of time the line is stopped for pouring.

In one embodiment, the measurement sensors or plates are attached to the frame on opposite sides of the mold as it passes under or through the frame. Measurement means other than plates can be used, such as discs, probes, rods, and similar sensors. The frame and plates are positioned so that as the production line moves a mold under or through the frame, the mold being tested stops underneath the frame in a position for testing while the line stops for pouring at the pour station further down the line. While the line is stopped, the plates are extended and pressed against opposite sides of the mold being tested. The contact sides of the plates may be flat, as shown, but also may be patterned, textured, or the like to increase the quality of contact with the mold. The measurements are taken quickly during the time the line is stopped, so that an evaluation of the measurements, and thus, the quality and integrity of the mold, can be made before the mold enters the pour station.

When the plates are in contact with the mold, the mold's electrical properties are measured. An LCR meter, or similar device, may be used to measure the electrical properties. In one exemplary embodiment, the electrical properties measured comprise resistance and capacitance.

As the electrical properties of molds can vary over time, the comparison of these properties to absolute standards may not give reliable information about the integrity of a particular mold. Accordingly, in one exemplary embodiment, the present invention recognizes unusual shifts in a mold's electrical properties compared to a particular number of recently tested molds. The electrical measurements for the mold being tested are compared to the electrical measurements determined for the previous number of molds, and if there is significant deviation, the mold is determined to be defective. In an alternative embodiment, an algorithm comprising a neural network is used to choose a range that represents a probability of the mold leading to a defective casting. This range can be adjusted where the smaller the range, the higher the probability of a defective mold so that a cost effective range can be found.

In one particular embodiment, the inputs to the neural network are the previous 15 measurements. The inputs further may comprise a normalized set of points in which the resistance measurements are divided by the capacitance measurements. In another embodiment, additional inputs may include measurements on one or more molds following the mold in question, to help determine whether a variation in that mold represents a defective mold, or a change in general mold character, a change in the measuring device, or other similar reason.

In one exemplary embodiment, the measuring device is connected to a programmable logic controller (PLC) which controls the production line, and a computing device with a program to collect data from the mold testing and perform the analysis to determine the mold quality. The PLC interfaces with the mold and pour machines in addition to the computing device. The PLC also performs other tasks, including, but not limited to, thermocouple measurement of the measurement plate temperature, heating the plates up to prevent sand from sticking, and detecting if one or more of the plates are stuck against the sand mold being tested.

In yet another embodiment, the measuring device is incorporated into the mold machine itself. Measurements may be taken on multiple sides of a mold simultaneously.

DETAILED DESCRIPTION OF EXEMPLARY EMBODIMENTS

The capacitance and resistance of a greensand mold in situ can correspond to certain characteristics of the mold, particularly moisture content, void space volume, and compaction. The measured capacitance and resistance of a greensand mold, however, can vary depending on the conditions under which the mold was formed and transported. Accordingly, the integrity of a greensand mold cannot be determined by comparison of such measurements to an absolute standard.

In one exemplary embodiment, the present invention measures the capacitance or resistance, or both, of a greensand mold in a production line after the mold is made but prior to the pouring station. The measurements may be taken in or at the mold machine, or alternatively, may be taken as close to the pouring station as practical in order to capture any problems or imperfections in the mold caused by transport of the mold on the production line. In the latter case, measurements are taken far enough away to take accurate measurements and make a decision to pass/fail the mold and bypass or remove the mold in a timely fashion.

Figure 1:
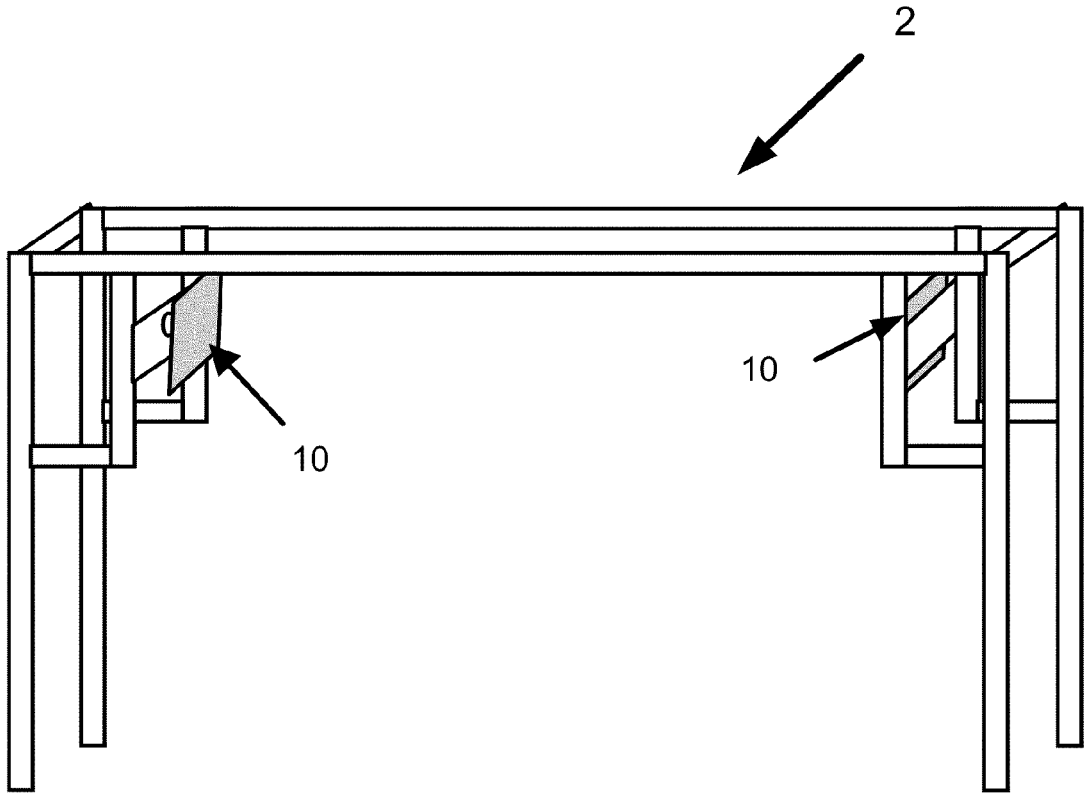
FIG. 1 is a side view of a mold production line frame for capacitor sensor placement to each side of a greensand mold.
Figure 2:
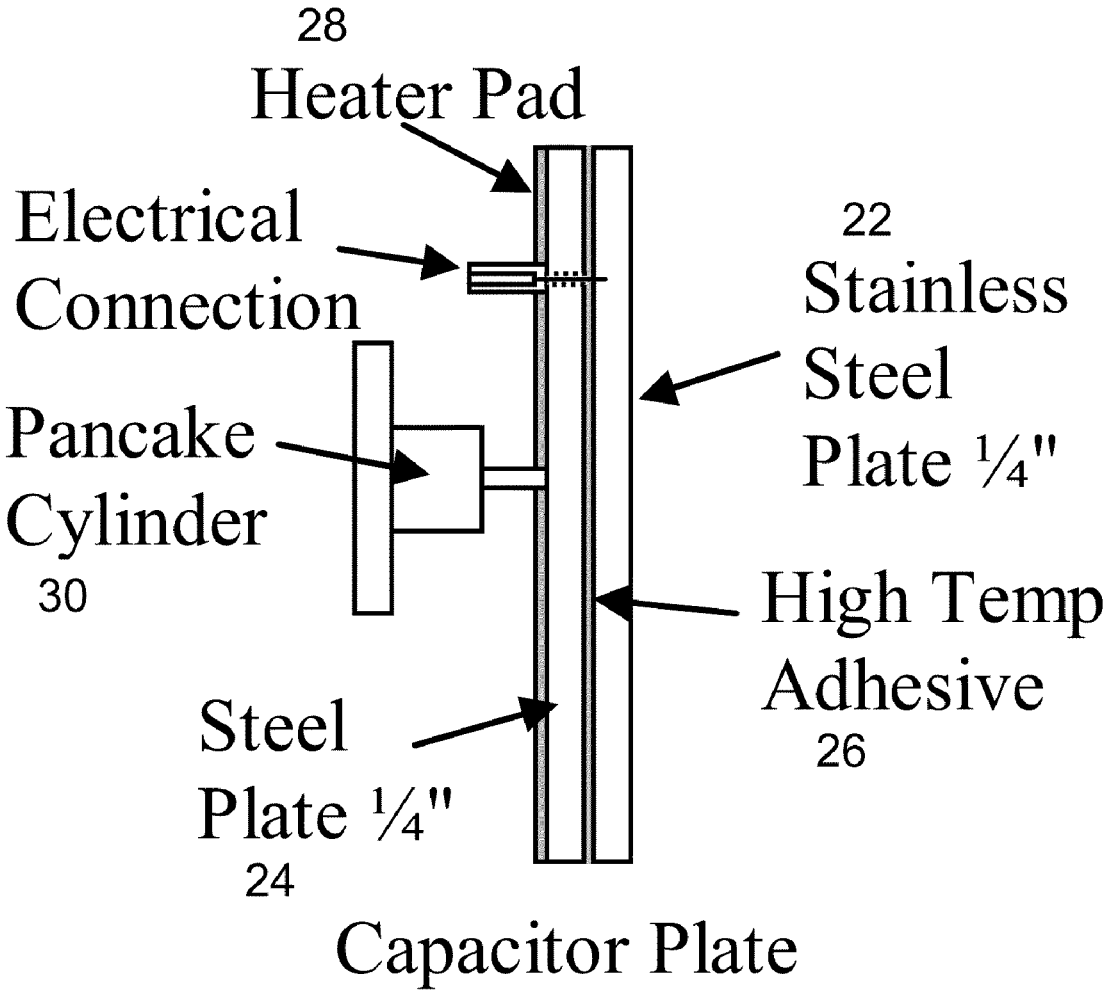
FIG. 2 is a side view of a capacitor plate used in a mold line frame.

FIG. 1 shows one exemplary embodiment of a greensand mold measuring device comprising a pair of measurement sensors or plates 10 supported by a frame 2. The frame may be made of any suitable material, including but not limited to steel, iron, aluminum, or a metal alloy. In one embodiment, the frame 2 straddles the mold production line between the mold machine and the pour station, although alternative configurations are possible, such as a support passing under the production line, two separate support stands on either side of the production line, or the like. The location of the frame with respect to the pour station depends on the speed of the production line, the time to perform the test, and the time to complete the test and make a decision to remove the mold as faulty. In one exemplary embodiment, the frame is positioned on the mold production line approximately 8 molds (or steps) before the pour station.

The time to perform the test should be as short as possible in order to reduce or avoid any delay in the production line. In a preferred embodiment, the time to perform the test is equal to or less than the amount of time the line is stopped for pouring.

In one embodiment, the measurement plates 10, as seen in FIG. 1, are attached to the frame 2 on opposite sides of the mold as it passes under or through the frame. Measurement means other than plates can be used, such as discs, probes, rods, and similar sensors. The frame and plates are positioned so that as the production line moves a mold under or through the frame, the mold being tested stops underneath the frame in a position for testing while the line stops for pouring at the pour station further down the line. While the line is stopped, the plates are extended and pressed against opposite sides of the mold being tested. The contact sides of the plates may be flat, as shown, but also may be patterned, textured, or the like to increase the quality of contact with the mold. The measurements are taken quickly during the time the line is stopped, so that an evaluation of the measurements, and thus, the quality and integrity of the mold, can be made before the mold enters the pour station.

In one exemplary embodiment, the measurement plate comprises a stainless steel plate 22, which comes into contact with the mold, affixed to a steel plate 24 by an adhesive 26. A heater pad or heating element 28 may be affixed to the side of the steel plate opposite the stainless steel plate to heat the plates and prevent the plates from being stuck against the mold. Other forms of heating the plates or sensor may be used. A pancake cylinder 30 or similar device is used to extend and retract the plates. An electrical power source (or other power source) is connected to the stainless steel plate.

When the plates are in contact with the mold, the mold's electrical properties are measured. An LCR meter, or similar device, may be used to measure the electrical properties. In one exemplary embodiment, the electrical properties measured comprise resistance and capacitance. As the electrical properties of molds can vary over time, the comparison of these properties to absolute or established standards, while it may be done, may not give reliable information about the integrity of a particular mold. Accordingly, in one exemplary embodiment, the present invention recognizes unusual shifts in a mold's electrical properties compared to a particular number of recently tested molds. The electrical measurements for the mold being tested are compared to the electrical measurements determined for the previous number of molds, and if there is significant deviation, the mold is determined to be defective. In an alternative embodiment, an algorithm comprising a neural network is used to choose a range that represents a probability of the mold leading to a defective casting. This range can be adjusted where the smaller the range, the higher the probability of a defective mold so that a cost effective range can be found.

In one particular embodiment, the inputs to the neural network are the previous 15 measurements. The inputs further may comprise a normalized set of points in which the resistance measurements are divided by the capacitance measurements. In another embodiment, additional inputs may include measurements on one or more molds following the mold in question, to help determine whether a variation in that mold represents a defective mold, or a change in general mold character, a change in the measuring device, or other similar reason.

Figure 4:
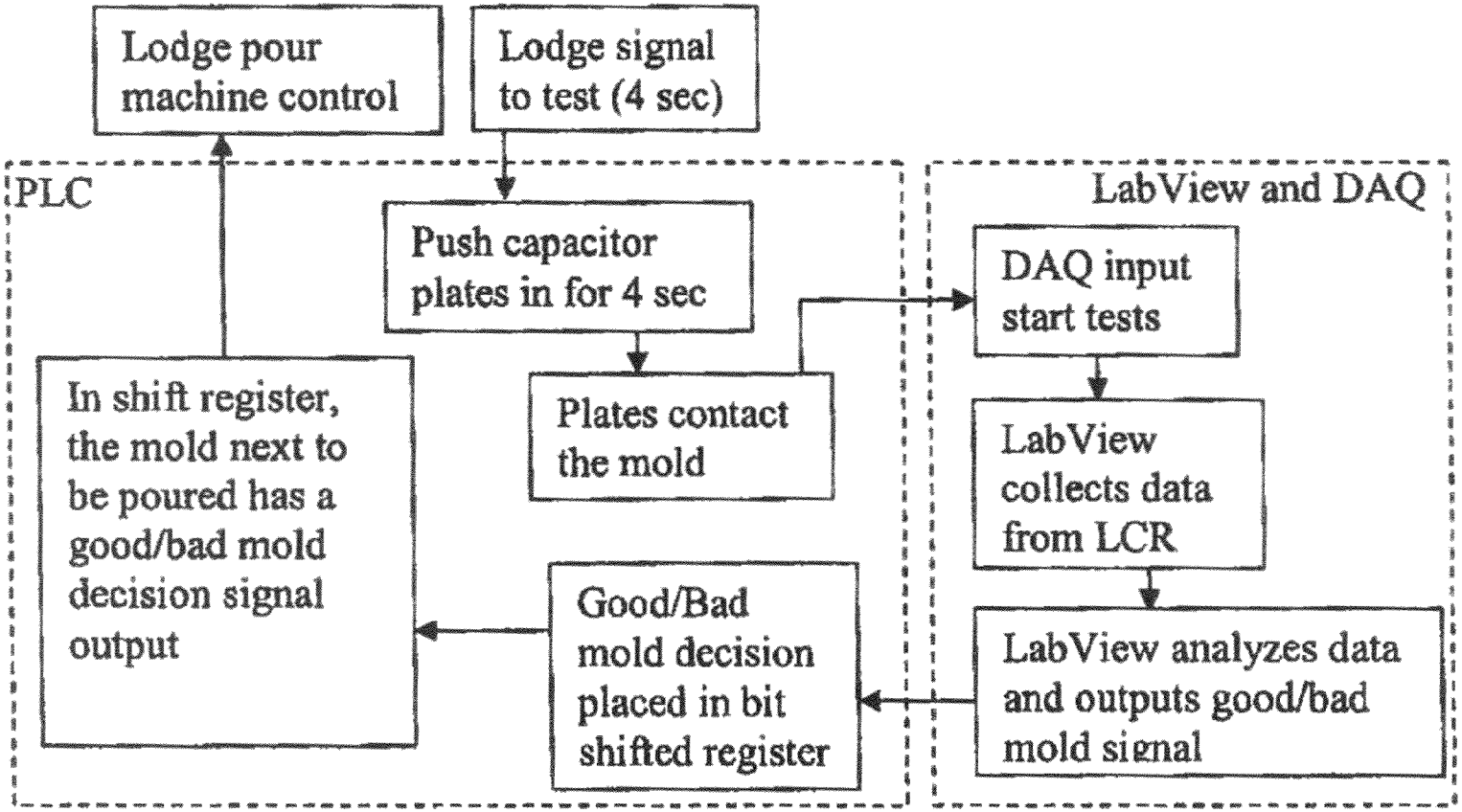
FIG. 4 is a block diagram of the control system decision-making process.

In one exemplary embodiment, the measuring device is connected to a programmable logic controller (PLC) which controls the production line, and a computing device with a program to collect data from the mold testing and perform the analysis to determine the mold quality. The PLC interfaces with the mold and pour machines in addition to the computing device. The block diagram in FIG. 4 illustrates a control system for one embodiment. The PLC receives that the pour is taking place (i.e., the signal to test), and causes the measurement plates to be pushed into contact with the mold for the appropriate period of time (e.g., 4 seconds, although other periods of time may be suitable). The computing device starts the testing, and collects data from the meter. The computing device then analyzes the data by comparing it to the data from preceding tests, and outputs a "good/bad" or "pass/fail" signal to the PLC. This signal is placed into a bit-shifted register and the pour machine bypasses that particular mold when it comes to the pour station.

Figure 3:
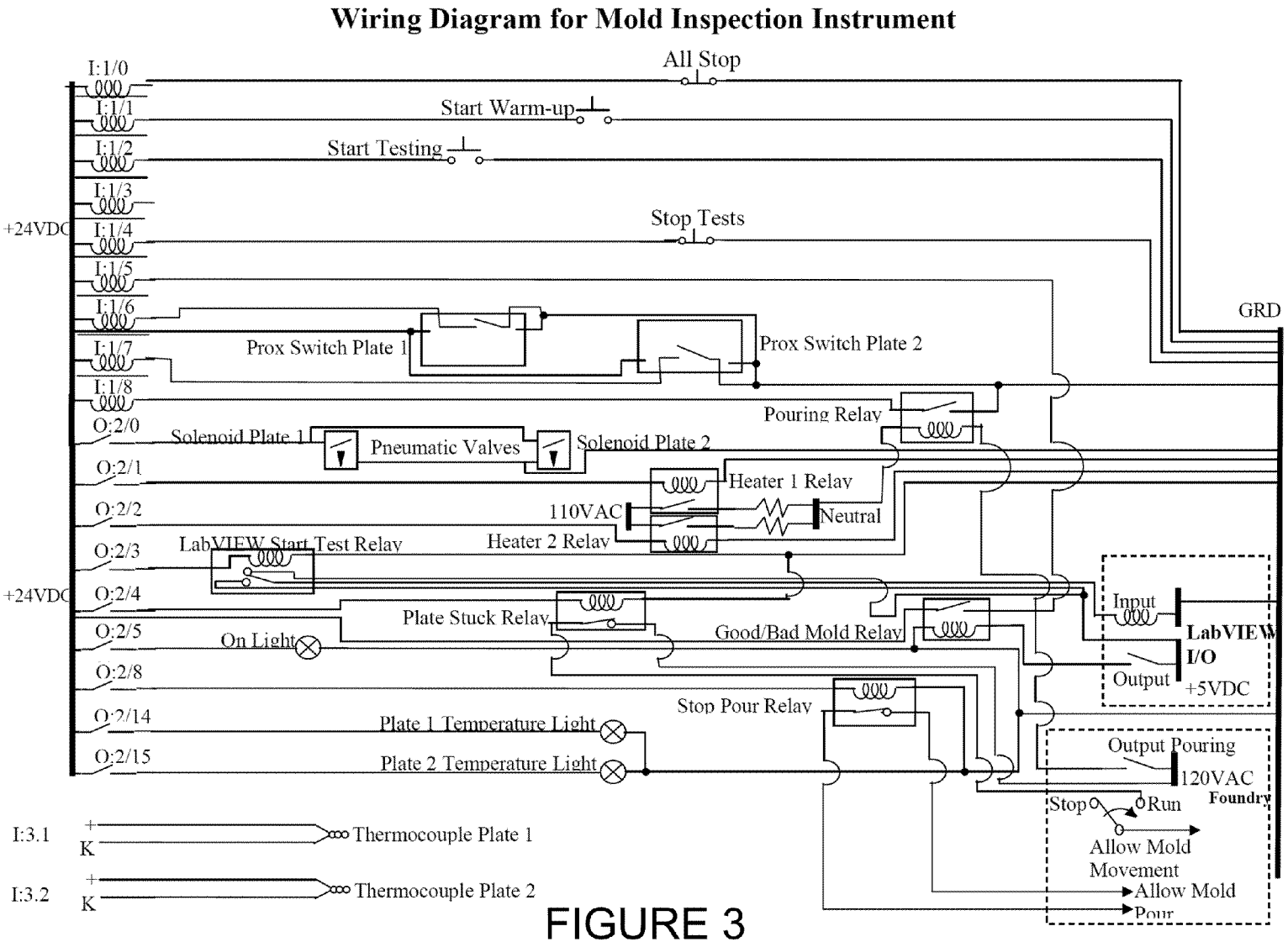
FIG. 3 is a diagram for a PLC controller for a mold line inspection instrument.

The PLC also performs other tasks, including, but not limited to, thermocouple measurement of the measurement plate temperature, heating the plates up to prevent sand from sticking, and detecting if one or more of the plates are stuck against the sand mold being tested (and thereupon signal the production line to stop moving). An exemplary wiring diagram for the PLC controller is shown in FIG. 3.

Figure 5:
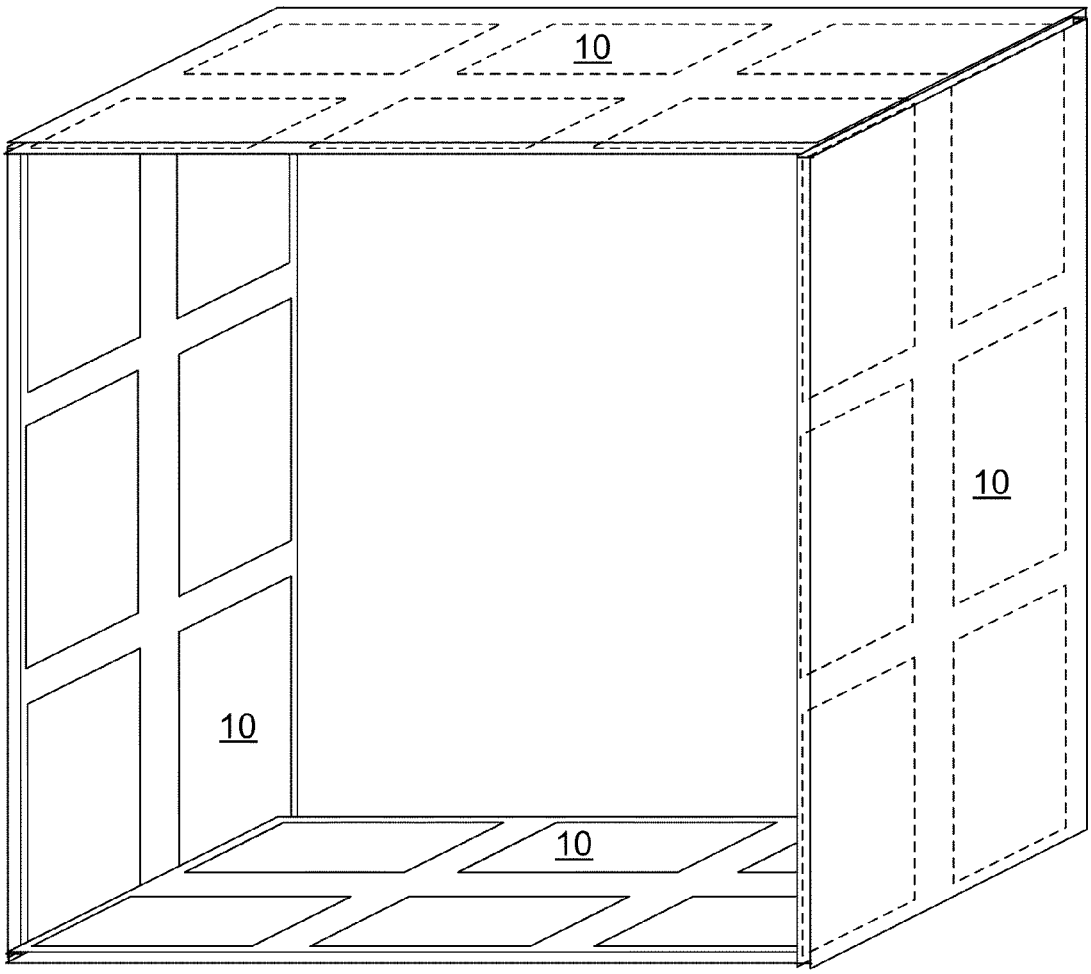
FIG. 5 is a diagram of a device with multiple sensors per side, with sensors on four sides of the mold.

The number of sides of the mold being measured may vary, and may include one, two, three, four, five, or all six sides (or more, if the mold is not in a six-sided form). The number of sensors or plates per side also may vary, and may include one, two, or more per side. Measurements can be taken between different sensors on the same side, or between sensors on different sides. Measurements can also be taken between groups of sensors. FIG. 5 shows a configuration with multiple sensors or plates 10 on four sides (in this example, there are six sensors or plates per side). This configuration may, of course, be used with a frame or support as described above, but also may be incorporated into a molding machine itself. Other configurations of sensors also may be incorporated into a molding machine.

Figure 6:
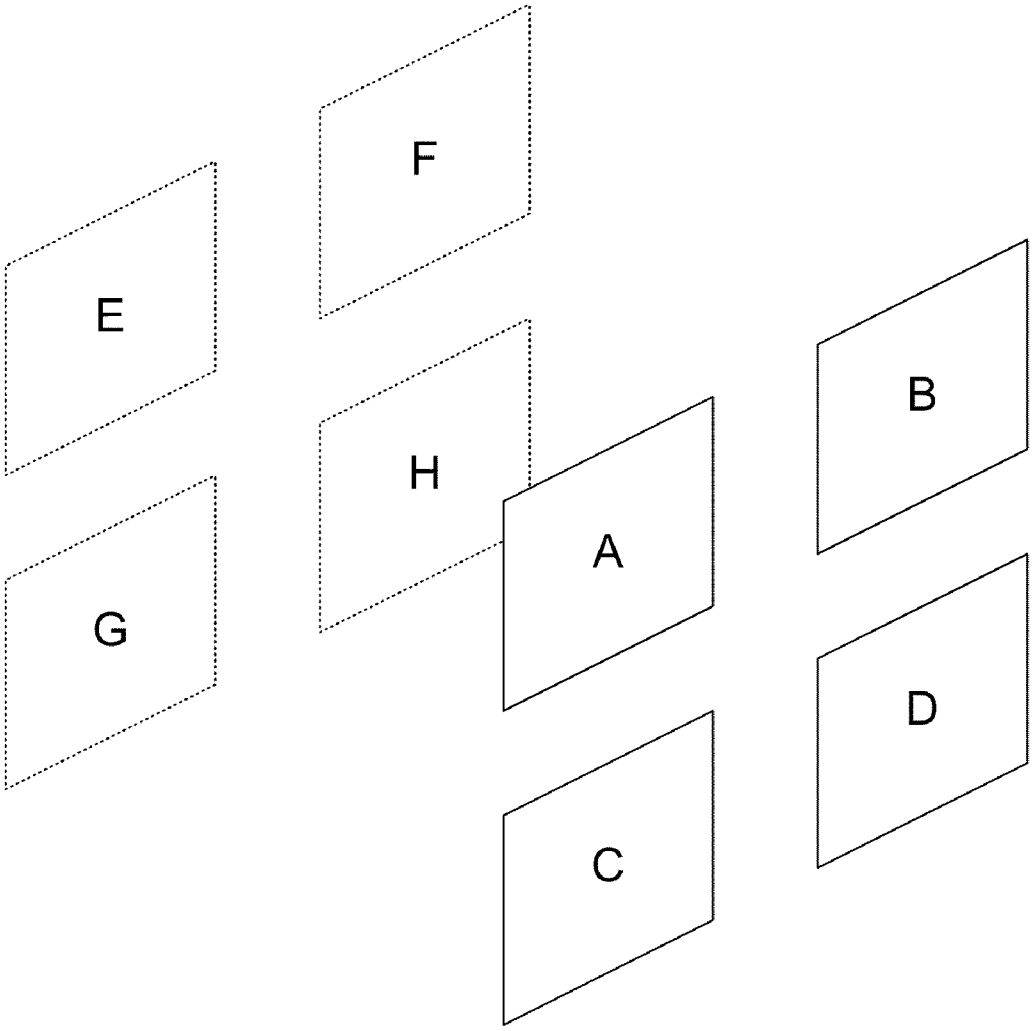
FIG. 6 is a diagram of a configuration with four sensors or plate per side on two sides (A, B, C, D and E, F, G, H).

FIG. 6 shows a configuration with four sensors or plates per side, on two opposing sides of a mold. Sensors A, B, C and D are on one side of the mold, while sensors E, F, G and H are on the other side of the mold. Measurements can be taken between different sensors on the same side, e.g., A and B; C and D; E and F; G and H; B and C; A and D, etc. Measurements also may be taken between sensors on different sides, e.g., A and E. Sensors also may be combined in groups, with measurement taken between the groups, e.g., [AB] and [CD]; [ABCD] and [EFGH].

Figure 7A:
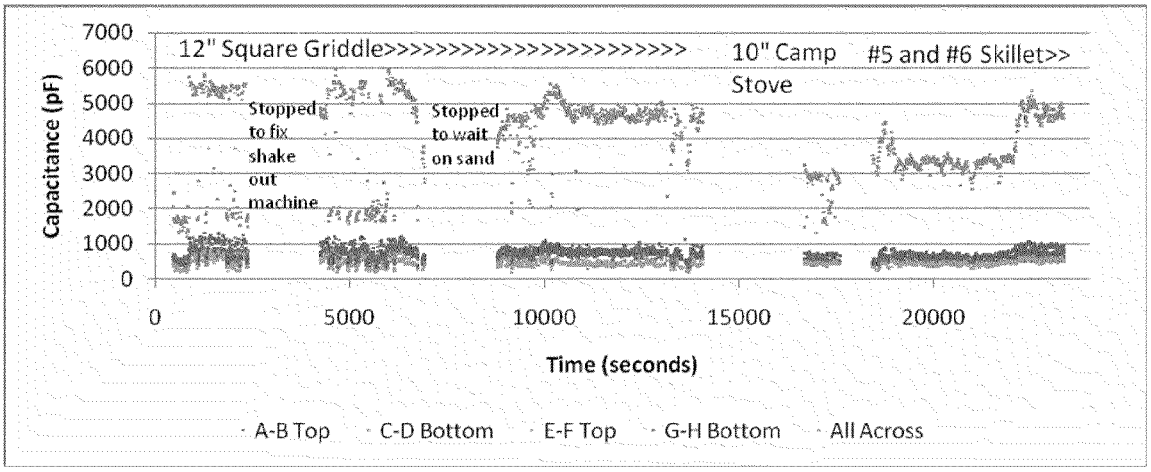
FIGS. 7A-N show examples of measurement data for a number of different sand molds between various sensors or plates in the configuration shown in FIG. 6.
Figure 7B:
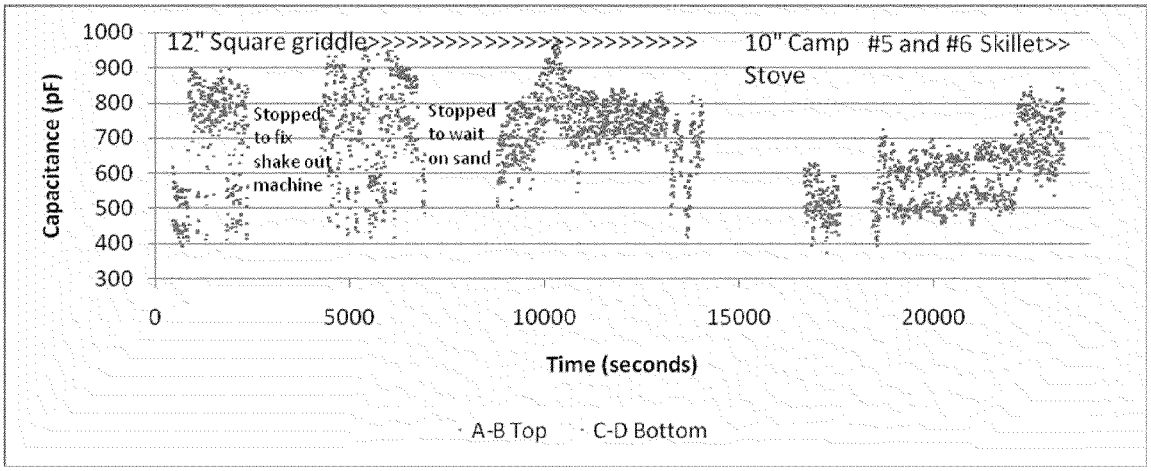
Figure 7C:
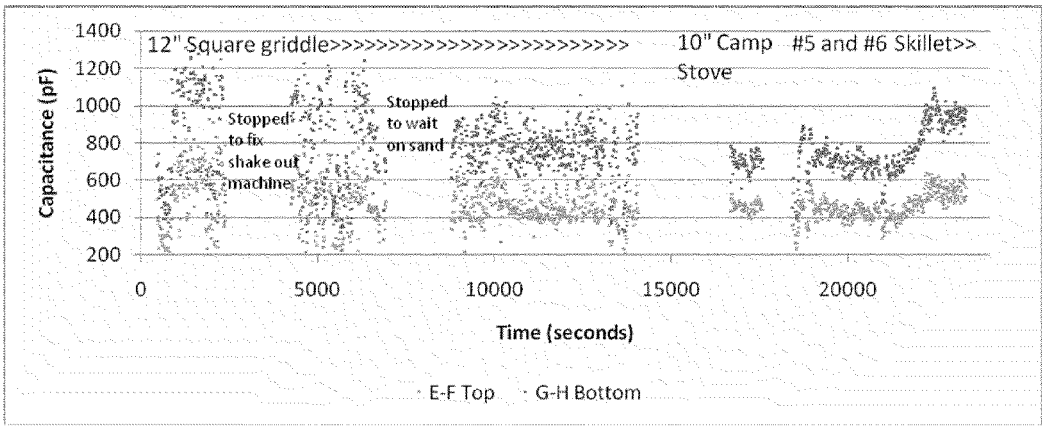
Figure 7D:
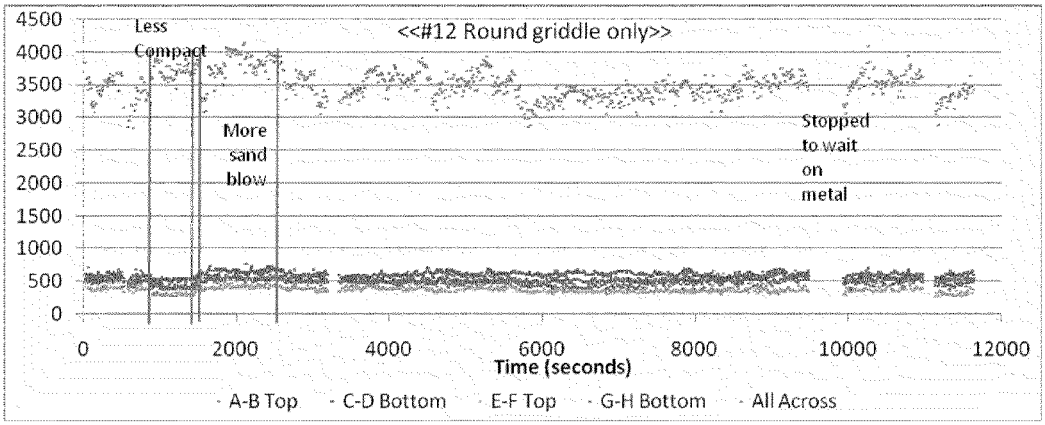
Figure 7E:
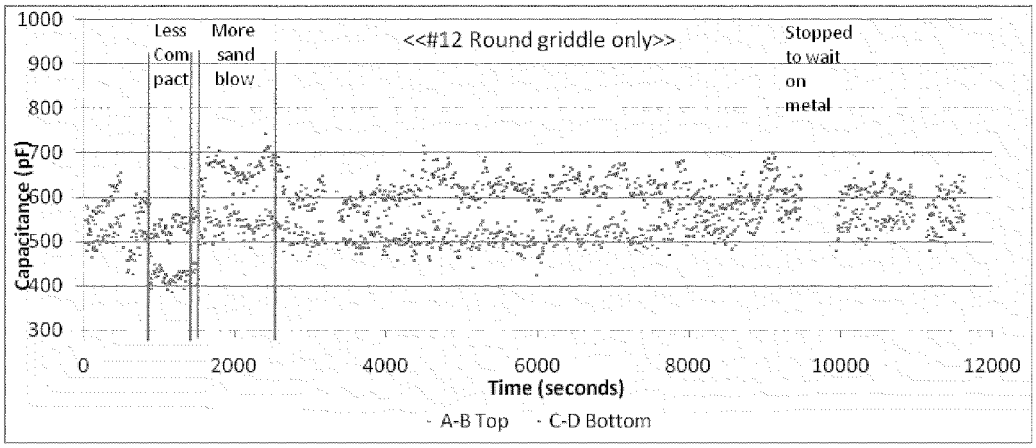
Figure 7F:
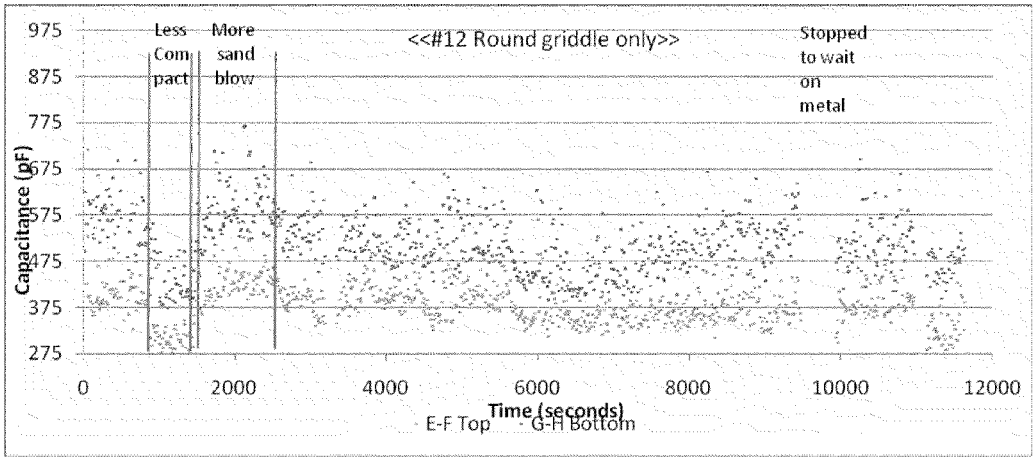
Figure 7G:
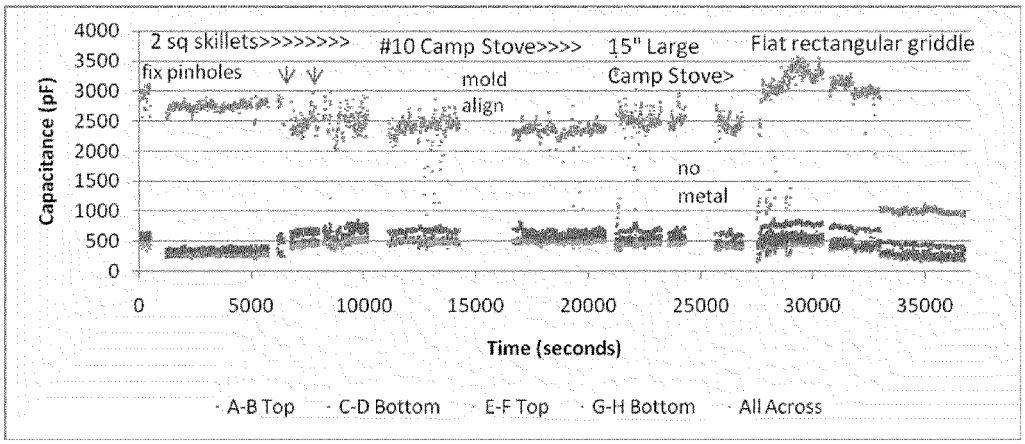
Figure 7H:
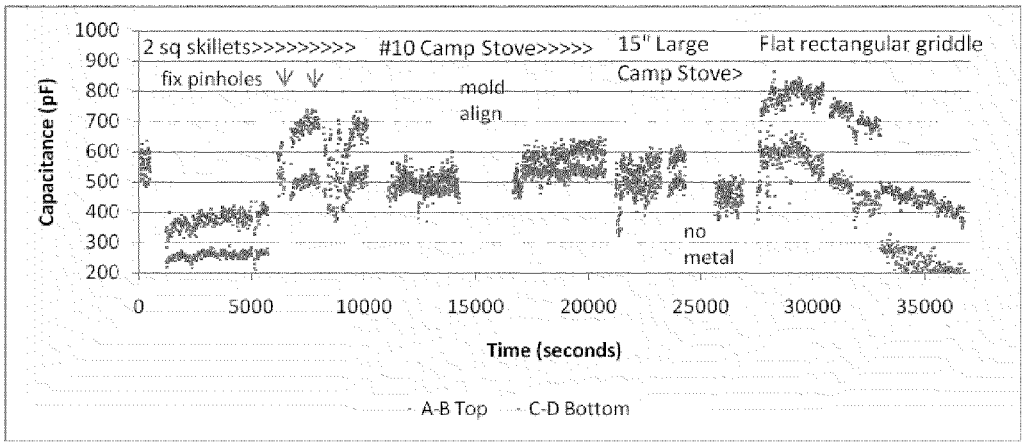
Figure 7M:
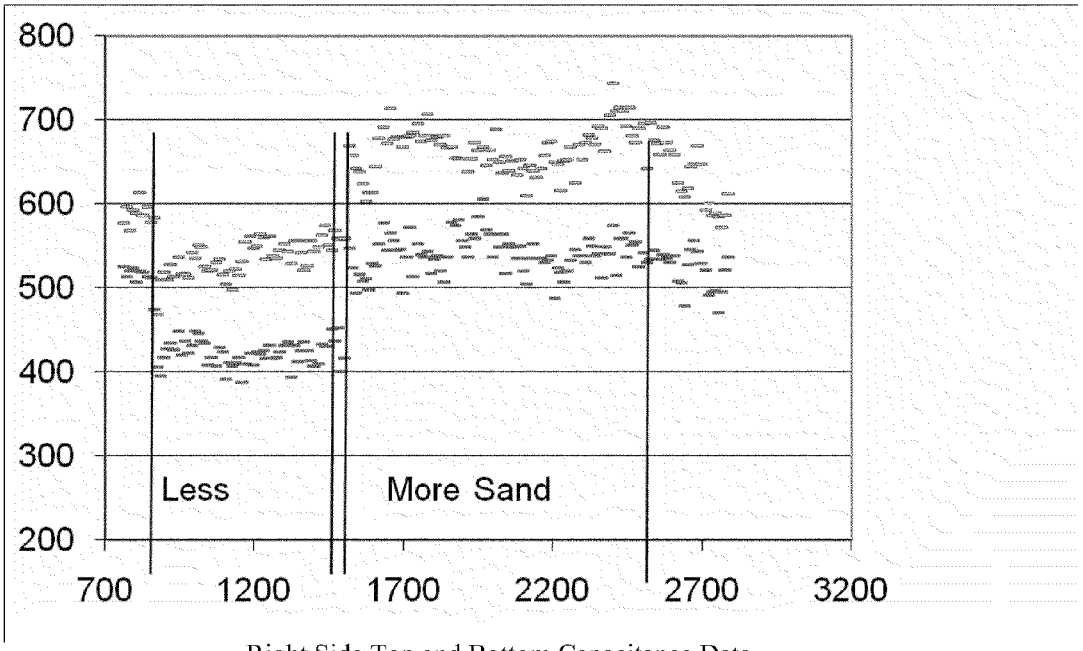
Figure 7N:
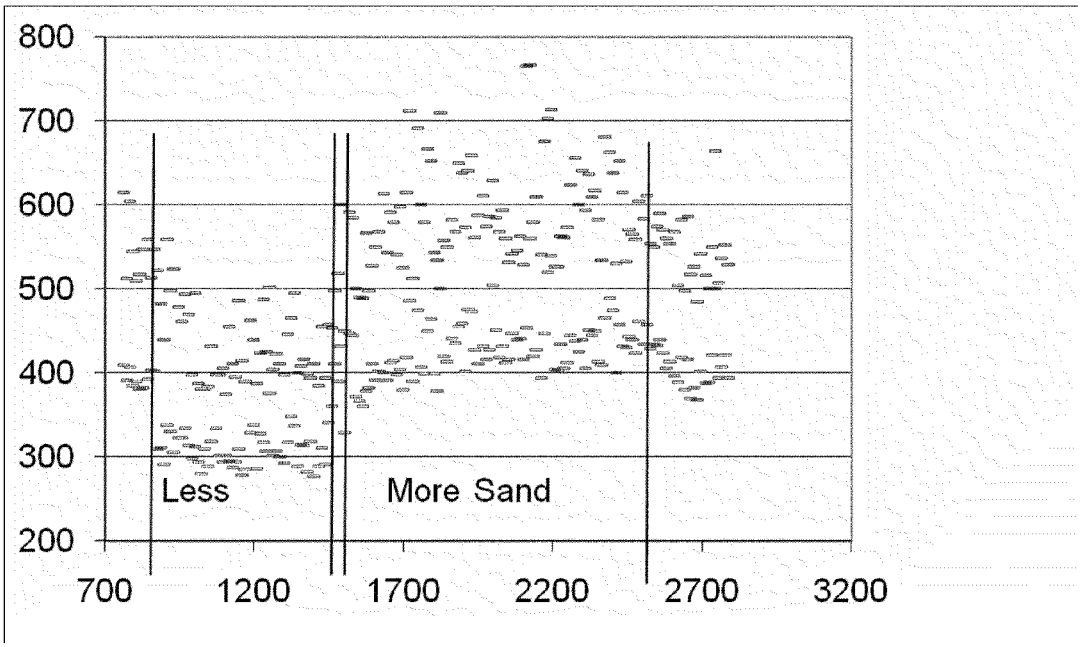

Measurements can vary, depending on what area of the mold is being measured, the depth of investigation, and the type of mold. Thus, defects in particular parts of a mold can be detected. FIG. 7A-N shows examples of capacitance measurements for a number of sand molds on a production line, for different types of castings as indicated (e.g., 12" square griddle, 10" camp stove, #5 and #6 skillet). Measurements were taken along the same side between adjacent sensors, top and bottom (i.e., A-B; C-D; E-F; and G-H), along with a measurement across the entire mold between the groups of four sensors on both sides (i.e., "All Across", [ABCD]-[EFGH]).

Variations in the measurements are readily apparent. A user or operator of a production line or other industrial process using greensand molds can observe the data, which can be presented in real time in numerical or graphic format, and stop the production line or process and make corrections or adjustments as needed or where warranted. For example, notations in the figures indicate where adjustments to the mold machine (e.g., fixing pinholes; aligning the mold; more sand vs. less sand) were made. In alternative embodiments, an signal or warning can be given if a given measurement, or series of recent measurements, exceed or go beyond a certain range or threshold level. This could be based on slope or standard deviation of the data. The signal or warning could be a visual signal (e.g., a red light; a warning notice on a computer display or system monitor) or an audible signal, or a combination of both. In one exemplary embodiments, the system may send an electronic warning, such as a phone call, an email, or a text message, to one or more users or operators, which may include such a warning being sent to a PDA, cell phone, smart phone, portable computing device, or similar device.

Thus, it should be understood that the embodiments and examples have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A method for determining the integrity of a particular sand mold, comprising the steps of:

moving a sand mold into position on an assembly line adjacent to a frame supporting two measurement sensors;

moving the measurement sensors to come into contact with opposing sides of the sand mold;

measuring the electrical characteristics of the sand mold with the measurement sensors; and comparing the electrical characteristics of the sand mold to a set of electrical characteristics derived from the electrical characteristics of a plurality of recently tested sand molds on the same assembly line, wherein the recently tested sand molds including one or more sand molds tested immediately after the particular sand mold.

2. The method of claim 1, further comprising the step of giving the sand mold a pass/fail status based on the comparison.

3. The method of claim 1, wherein the measurement sensors are steel plates.

4. The method of claim 3, wherein the steel plates are heated.

5. The method of claim 1, wherein the electrical characteristics comprise capacitance, resistance, or both.

6. The method of claim 5, wherein the step of comparing comprises the calculation of a normalized set of points where resistance measurements are divided by the capacitance measurements.

7. The method of claim 1, wherein the assembly line comprises a pour station, and the frame is positioned eight or fewer steps before the pour station.

8. The method of claim 7, wherein the determination of integrity of the sand mold is controlled in whole or in part by a programmable logic controller.

* * * * *